US008667696B2

(12) United States Patent
Zdroik et al.

(10) Patent No.: US 8,667,696 B2
(45) Date of Patent: Mar. 11, 2014

(54) ROTARY CUTTER

(76) Inventors: Ronald J. Zdroik, Wauwatosa, WI (US); Garet K. Galster, Oconomowoc, WI (US)

( * ) Notice: Subject to any disclaimer, the term of this patent is extended or adjusted under 35 U.S.C. 154(b) by 218 days.

(21) Appl. No.: 13/280,332

(22) Filed: Oct. 24, 2011

(65) Prior Publication Data

US 2012/0096719 A1 Apr. 26, 2012

Related U.S. Application Data

(60) Provisional application No. 61/406,115, filed on Oct. 23, 2010.

(51) Int. Cl.
*B26B 3/00* (2006.01)
*B26D 1/157* (2006.01)

(52) U.S. Cl.
USPC ..... 30/307; 30/306

(58) Field of Classification Search
USPC ..... 30/292, 299, 304, 306, 307, 319
See application file for complete search history.

(56) References Cited

U.S. PATENT DOCUMENTS

| | | | | | |
|---|---|---|---|---|---|
| 417,167 | A | * | 12/1889 | Gibson | 30/292 |
| 769,081 | A | * | 8/1904 | Hemington | 30/265 |
| 895,969 | A | * | 8/1908 | Coyle | 30/307 |
| 976,496 | A | * | 11/1910 | Reiser | 30/365 |
| 1,098,671 | A | * | 6/1914 | Lundy | 83/105 |
| 1,416,106 | A | * | 5/1922 | McWhorter | 30/307 |
| 1,511,892 | A | * | 10/1924 | Lusby | 30/265 |
| 1,560,355 | A | * | 11/1925 | Snyder et al. | 30/292 |
| 1,720,305 | A | * | 7/1929 | Tjernlund | 30/265 |
| 1,856,435 | A | * | 5/1932 | Schwarz | 172/16 |
| 2,947,084 | A | * | 8/1960 | Billings | 33/32.2 |
| 3,174,223 | A | | 3/1965 | Gerson | |
| 3,281,938 | A | * | 11/1966 | Lee | 30/365 |
| 3,711,945 | A | | 1/1973 | Cronheim | |
| 3,924,328 | A | | 12/1975 | Mould | |
| 4,155,142 | A | * | 5/1979 | Demetriadis | 15/236.06 |
| 4,423,551 | A | | 1/1984 | Chmela et al. | |
| D286,608 | S | | 11/1986 | Leung | |
| 4,993,157 | A | | 2/1991 | Wang | |
| D358,306 | S | | 5/1995 | Heckroth | |
| 5,469,622 | A | | 11/1995 | Gradoni | |
| 6,460,254 | B1 | | 10/2002 | Mori et al. | |
| 6,484,407 | B2 | | 11/2002 | Khatchadourian et al. | |
| 7,043,843 | B2 | | 5/2006 | Krupka et al. | |
| 7,591,072 | B2 | | 9/2009 | Stravitz | |
| D614,925 | S | | 5/2010 | Blum | |
| 7,823,292 | B1 | | 11/2010 | Castiglione et al. | |
| 8,011,103 | B2 | | 9/2011 | Blum | |

(Continued)

FOREIGN PATENT DOCUMENTS

| | | | |
|---|---|---|---|
| JP | 52-28782 | * | 3/1977 |
| JP | 11056214 A | | 3/1999 |

*Primary Examiner* — Hwei C Payer

(57) ABSTRACT

Embodiments according to the present invention provide improved rotary cutters and associated methods. A cutter includes a handle coupled to a plurality of rotary cutting elements which may be rotatable substantially within the same plane, within closely spaced parallel planes, or within intersecting planes, wherein the intersection of such planes occurs substantially tangential to the rotary cutting elements. The rotary cutting elements are preferably different sized and preferably becoming smaller distally from the handle. A method includes cutting an article with a plurality of rotary blades with a single motion of a human hand and/or arm. Such article may be, for example, a food article, such as pizza, or a textile article, such as leather, vinyl, or even gypsum board.

1 Claim, 8 Drawing Sheets

(56) References Cited

U.S. PATENT DOCUMENTS

| | | | | |
|---|---|---|---|---|
| 2002/0129499 | A1 | 9/2002 | Khatchadourian et al. | |
| 2007/0045390 | A1 | 3/2007 | Kushner | |
| 2007/0251098 | A1 | 11/2007 | Smith et al. | |
| 2009/0223068 | A1 | 9/2009 | Sawhney et al. | |
| 2010/0269359 | A1 | 10/2010 | Blum | |
| 2010/0313432 | A1 | 12/2010 | Caswell | |
| 2012/0096719 | A1 * | 4/2012 | Zdroik et al. | 30/124 |

* cited by examiner

ROTARY CUTTER

RELATED APPLICATIONS

This application claims the benefit of co-pending U.S. Provisional Application Ser. No. 61/406,115, filed 23 Oct. 2010 and entitled Rotary Cutter, which is incorporated herein by reference in its entirety.

BACKGROUND OF THE INVENTION

Embodiments according to the present invention relate generally to the field of cutting, and more particularly to handheld devices utilizing a plurality of rotating cutting members.

Though handled rotary cutters have long been used, what has heretofore been unrecognized is that the shape and arrangement of rotary cutting blades may serve a secondary utilitarian function, e.g., lifting or transport of a cut article, thereby eliminating the need for other utensils, such as serving or transport devices.

With prior embodiments of rotary cutters, once an article was cut, resort was had usually to a second device, beside the rotary cutters, to perform other functions on the cut article, such as transportation of the article from one supporting surface to another. As an example, if a conventional rotary cutter is utilized to cut a foodstuff, such as a pizza pie, then a second device, usually a fork or serving utensil such as a spatula, is used to transport the pizza slices from the baking surface, or other first support surface, to a second support surface, such as a serving plate.

Accordingly, there remains room in the art of cutting devices for rotary cutters providing one or more utilitarian features other than cutting.

SUMMARY OF THE INVENTION

One embodiment according to the present invention includes a rotary cutter providing one or more utilitarian features other than cutting. A device according to the present invention comprises a handle including a free end and a mounting frame coupled to the handle. A first blade is coupled to the mounting frame, and it is rotatable about a first axis. A second blade is also coupled to the mounting frame, and it is rotatable about a second axis.

According to one aspect of the present invention, the handle may be formed integrally with the mounting frame.

According to another aspect of the present invention, the mounting frame may comprise a first mounting rail through which a first axle is mounted and the first blade is coupled to the mounting frame by being rotatably supported on the first axle.

According to yet another aspect of the present invention, the mounting frame may comprise a second mounting rail through which a second axle is mounted and the second blade is coupled to the mounting frame by being rotatably supported on the second axle. The first axle may extend through the second rail and the second axle may extend through the first rail.

According to still another aspect of a device according to the present invention, the handle may be formed along a handle longitudinal axis and further wherein the first axis, the second axis and the handle longitudinal axis are coplanar. The first axis and the second axis may be parallel, and the handle longitudinal axis may be perpendicular to the second axis.

According to a further aspect according to a device according to the present invention, the first blade may be a first circular blade having a first major diameter and the second blade may be a second circular blade having a second major diameter, wherein the first major diameter is different than the second major diameter. The second axis may be disposed between the first axis and the handle, and the first major diameter may be smaller than the second major diameter. For instance, the second major diameter may be greater than twice the first major diameter, or even at least three times the first major diameter. A transfer surface may be formed by the blades, where a first tangent intersects a first point on the first blade and a second point on the second blade, and a second tangent intersects a third point on the first blade and a fourth point on the second blade. The first tangent and the second tangent preferably intersect at a tangent vertex, where the first blade is located between the second blade and the tangent vertex. The tangent vertex may be coplanar with the first axis and the second axis. The first tangent and the second tangent may be disposed at a transfer surface angle of between about thirty degrees to about forty-five degrees.

According to still another aspect of a device according to the present invention, the mounting frame comprises a mounting plate including left and right surfaces oppositely disposed and separated by a mounting plate thickness. The left and right surfaces may be substantially planar and the mounting plate preferably includes a blade slot formed between the left and right surfaces, where the blade slot configured to receive at least a portion of the blades. The first blade may be a first circular blade having a first major diameter and the second blade may be a second circular blade having a second major diameter, wherein the first major diameter may be smaller than the second major diameter and the second axis may be disposed closer to the handle than the first axis. The first axis and second axis may be separated by a distance that is greater than the sum of the first major diameter and the second major diameter. A first tangent may intersect a first point on the first blade and a second point on the second blade. A second tangent may intersect a third point on the first blade and a fourth point on mounting plate. The first tangent and the second tangent preferably intersect at a tangent vertex, where the first blade may be located between the second blade and the tangent vertex. The first tangent and the second tangent may be disposed at a transfer surface angle of between about thirty degrees to about forty-five degrees.

According to an aspect of a method according to the present invention, such method includes the steps of providing a device configured to be supported in a single human hand, the device comprising a handle coupled to a plurality of blades, each blade being rotatably supported about a blade axis; and cutting, with one or more of the blades, an article supported on a first cutting surface to create a severed portion of the article. The method may further include the step of transferring, with the device, the severed portion of the article to a second supporting surface. The handle of the device may be formed along a handle longitudinal axis, and the method may further include the step of rotating the device about the handle longitudinal axis by ninety degrees prior to the step of transferring.

DESCRIPTION OF THE PREFERRED EMBODIMENT

Figure 1:
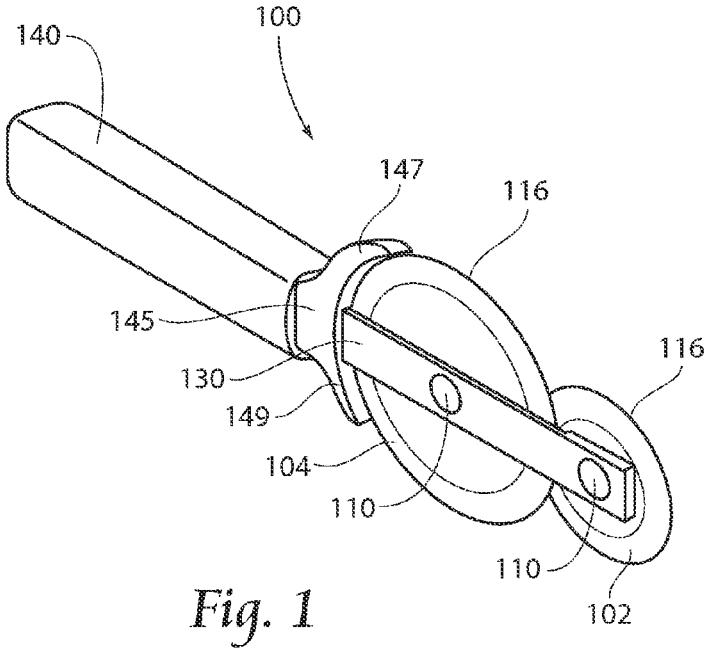
FIG. 1 is a perspective view of a first embodiment of a rotary cutter according to the present invention.
Figure 2:
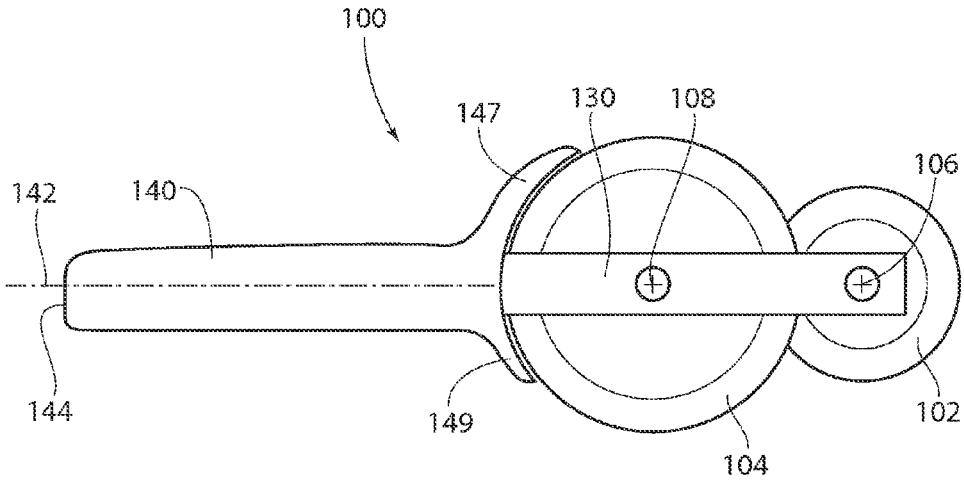
FIG. 2 is a left elevation view of the embodiment of FIG. 1.
Figure 3:
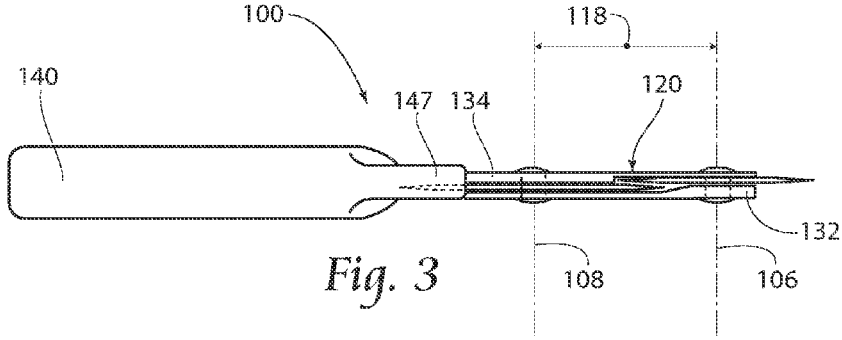
FIG. 3 is a top plan view of the embodiment of FIG. 1.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Embodiments according to the present invention provide devices and methods of cutting an article. The devices and methods of the present invention may be utilized to cut, for example, substantially planar articles such as textiles or foodstuffs, such as pizza.

Turning now to the Figures, a first embodiment 100 of a cutter according to the present invention may be seen generally in FIGS. 1-4A and 5-9. The cutter 100 includes a plurality of (at least two) rotary blades 102,104, each of which is preferably rotatably supported about a blade axis 106,108. The rotation of the blades 102,104 is preferably passive, such that an axle 110 on which a blade is supported does not turn synchronously with the blade. Rather, the blades 102,104 are preferably rotated about the axis 106,108 by a force imparted to them, such as proximate its outer edge or periphery. Each blade 102,104 preferably has a major diameter 112,114, half of which would be a radius measured from the center of the blade axis 106,108 to the outermost portion of the blade. Each blade preferably has a sharpened edge 116 that is substantially smooth about the major diameter. One or more of the blades 102,104 may have radial indentations (not shown) provided radially inward to a minor diameter measured from the blade axis, where the minor diameter is smaller than the major diameter.

Figure 4A:
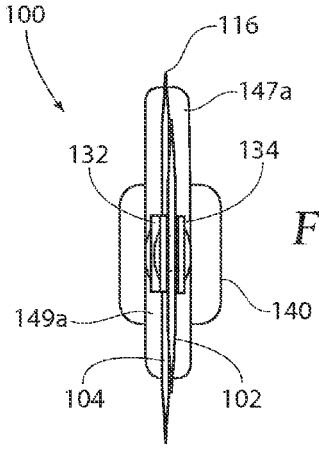
FIG. 4A is a front elevation view of the embodiment of FIG. 3.
Figure 4B:
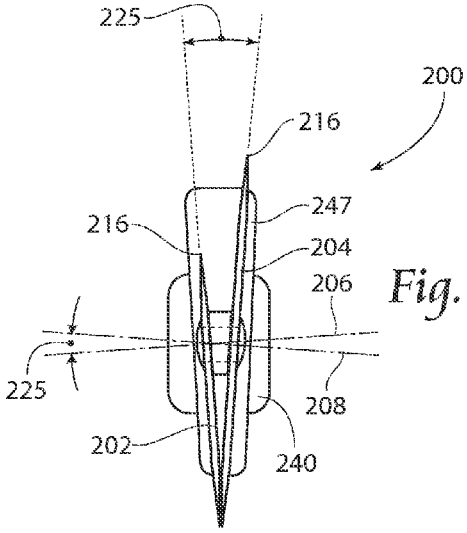
FIG. 4B is a front elevation view of a second embodiment of a cutter according to the present invention.
Figure 5:
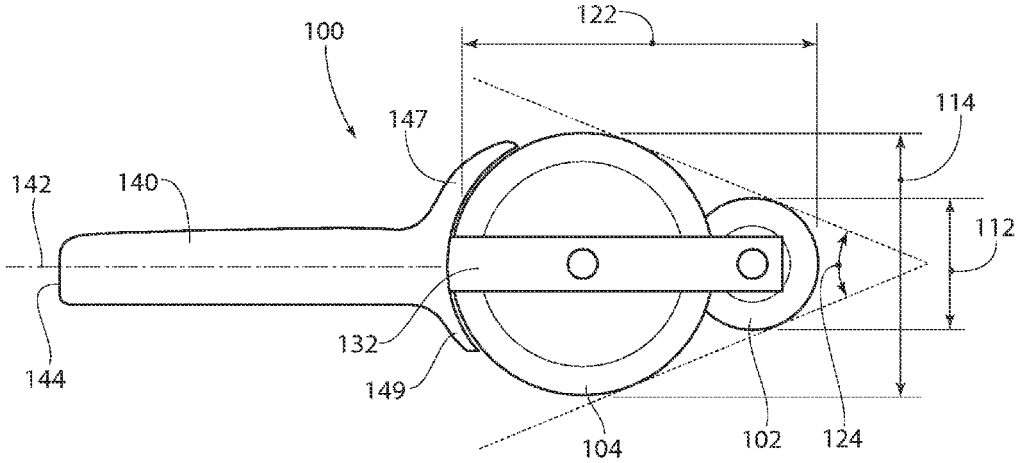
FIG. 5 is a left elevation view of the embodiment of FIG. 1.

The blade axes 106,108 are preferably spaced a predetermined axis spacing 118 from each other, and may be substantially parallel, or disposed at a predetermined angle with respect to each other, as can be seen in the second embodiment 200 in FIG. 4B. The space 118 between the blade axes 106,108 is preferably less than, but may be substantially equal to, or greater than the sum of the major radii of adjacent blades 102,104. The blades 102,104 may have substantially the same major and/or minor diameters, or they may be significantly different. As shown in the Figures, a first distal blade 102 may have a smaller major diameter than a second proximal blade 104. As is highlighted in FIGS. 5 and 8, such arrangement may create a transfer surface 120, such as a serving surface for foodstuffs, such as pizza. In other words, tangent lines extending from the periphery of the distal blade 102 to the periphery of the proximal blade 104 preferably generally form a wedge shaped transfer surface 120 so as to facilitate the serving of wedge shaped foodstuff slices. Thus, the cutting blades 102,104, themselves, may form a transfer surface 120 which approximates a predetermined cut-article shape, such as a wedge. The transfer surface 120 has a length 122 of preferably at least 60% of the expected length of a predetermined cut article, and more preferably at least 70% of such length. Thus, for a 12" diameter substantially circular article to be cut into wedges, the transfer surface length 122 is preferably at least 60% of 6", or at least 3.6", but more preferably at least 4.2". The shape of the transfer surface 120 may be formed generally by tangents to the outer edges 116 of the blades 102,104, which may be disposed at a desired support surface angle 124, such as about thirty degrees to about forty-five degrees.

Figure 6:
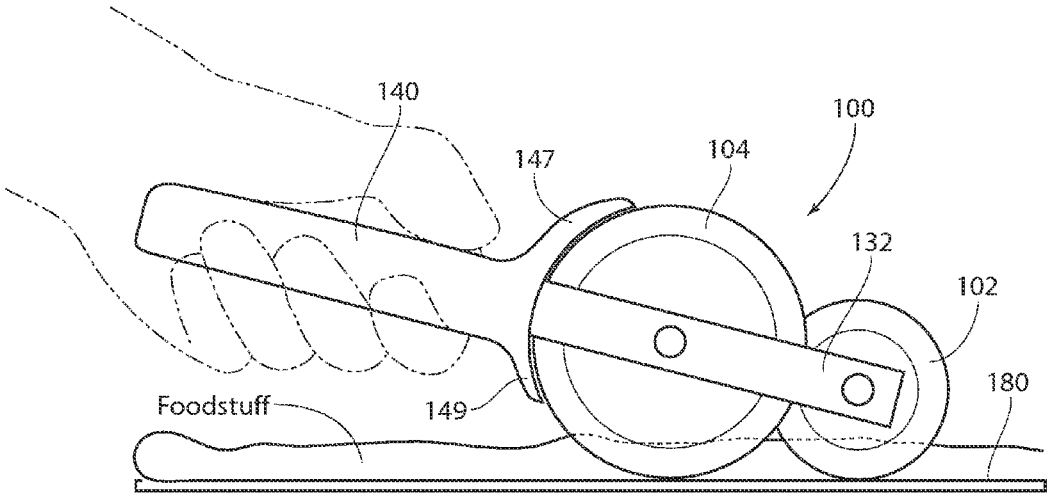
FIG. 6 is a left elevation view of the embodiment of FIG. 1 shown in use on a first cutting surface.
Figure 7:
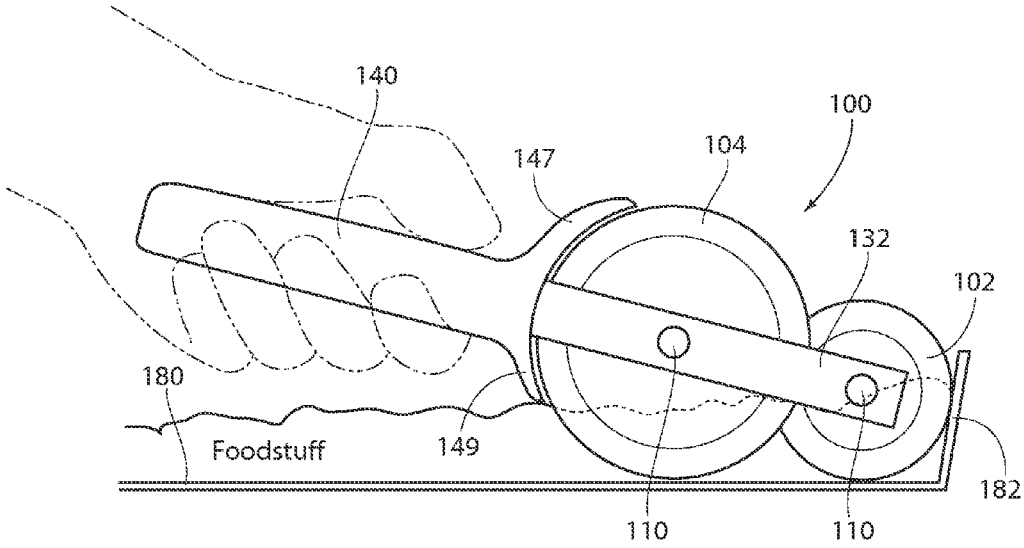
FIG. 7 is a left elevation view of the embodiment of FIG. 1 shown in use on a second cutting surface.
Figure 8:
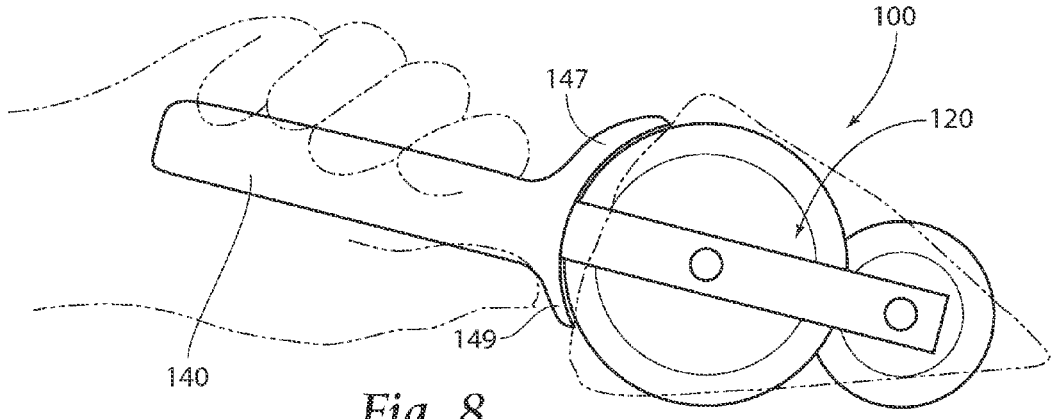
FIG. 8 is a left elevation view of the embodiment of FIG. 1 shown in use serving a foodstuff.
Figure 9:
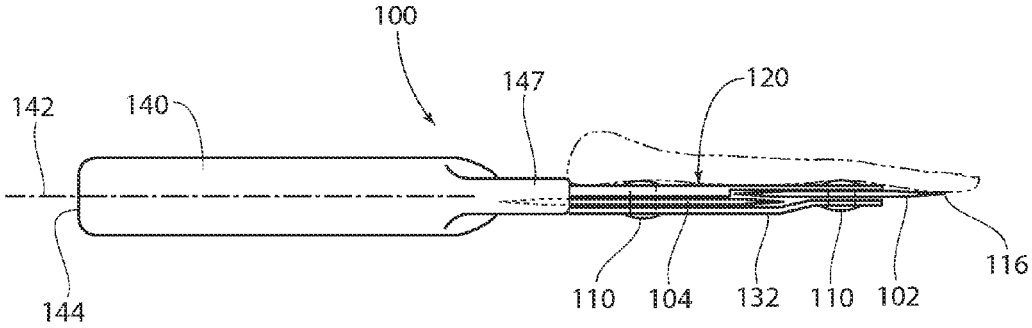
FIG. 9 is a top plan view of the embodiment of FIG. 1 shown in use serving a foodstuff.

A smaller distal rotary blade 102 also provides the advantage of a more complete cut towards the edge of a boxed foodstuff, and also allows for a precut by the distal blade 102 followed by through-cut by the proximal blade 104 in a single cutting stroke. In FIG. 6, a foodstuff is being sliced on a planar first support surface 180. Such surface 180 may be a cutting board or a piece of cardboard. However, foodstuffs are commonly provided in a box, which includes a box rim 182 extending substantially perpendicularly upwards from a horizontal cutting surface 180. As shown in FIG. 7, the major radius of the distal blade 102 is a limiting factor in cutting closer to the box rim 182. Thus, if the proximal blade 104 has a major diameter of about 3" and the distal blade 102 has a major diameter of about 1", then the smaller distal blade 102 provides the ability to slice the foodstuff article one full inch closer to the box rim 182 than if a rotary cutter having a single blade 104 were used.

A preferred major blade diameter 114 for the proximal blade 104 is from about 3" (preferred for serving smaller slices, or an about 12" diameter article or foodstuff) to about 6" (preferred for serving larger slices, or an about 22" diameter article or foodstuff) and a preferred major blade diameter 112 for the distal blade is from about 0.75" to about 1.75".

As indicated, the blade axes may be disposed at a predetermined blade cant or tilt angle, such as the second embodiment 200 shown in FIG. 4B, where similar reference numerals refer to similar or identical structure to the first embodiment 100. This blade tilt angle 225 arrangement is particularly useful if the blade axes 206,208 are spaced a distance of less than the sum of adjacent major blade radii and if it is desirable to have a very narrow cutting kerf made by both blades 202,204 together in a single cutting stroke. Such arrangement may be suited for cutting textiles such as heavy leather or vinyl. A preferred tilt angle 225 is from zero degrees to about forty-five degrees.

The blades 102,104 may be supported on axles 110 that are either fixed to or rotatably mounted on a frame structure 130. The frame structure 130 may include substantially planar, parallel rails 132,134. While the outer surface of the rails 132,134 is preferably substantially planar, an inner surface thereof, which generally faces the blades 102,104 when the device 100 is assembled, may have staggered indentations to accommodate blade orientation, which can best be seen in FIG. 3. Although shown with two rails 132,134, the frame structure 130 may be formed from only a single rail 132 or 134. Also, while each rail 132,134 is shown coupled to both axles 110, in another embodiment (not shown) where two rails 132,134 are used, then each rail may support only a single blade 102 or 104. The blades 102,104, rails 132,134, and axles 110 are preferably formed from a stainless steel material.

Coupled to (or formed integrally with) and supported by the frame structure 130 is a handle 140, preferably configured to be grasped by a human hand. The handle 140 may extend along a longitudinal axis 142, substantially longitudinally away from the blades 102,104 to a free proximal end 144. In this way, the handle longitudinal axis 142 may lie substantially orthogonal to each of the blade axes 106,108. Accordingly, downward cutting pressure may be applied to the blades 102,104 through a levering action provided by a hand grasping the handle 140. An optional blade guard 145 may be provided as extending from or coupled to the handle 140. The blade guard 145 may have a first extension 147 and a second extension 149 extending radially outwardly from the handle 140. While the first extension 147 and second extension 149 may be substantially symmetrical, one may be longer than the other. As shown, the first extension 147 has a surface 147*a* that runs substantially parallel to, but spaced from the outer edge 116 of the proximal blade 104. The second extension 149 also has such a surface 149*a*, but it extends about the proximal blade 104 for a shorter distance than the first extension 147.

Figure 10:
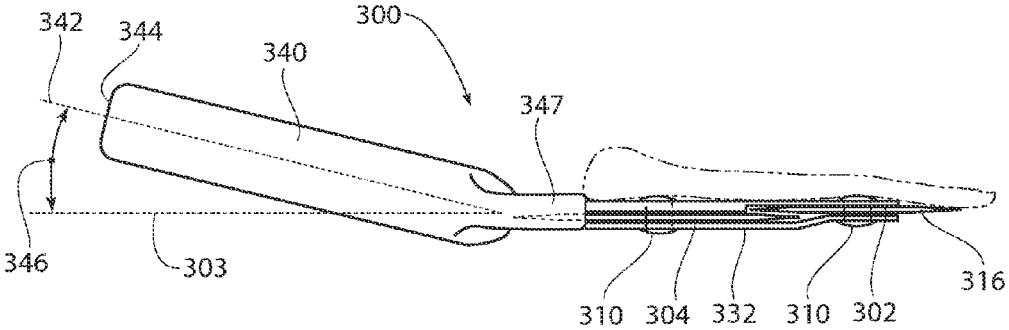
FIG. 10 is a top plan view of a third embodiment of a cutter according to the present invention.

A third embodiment of a cutter 300 according to the present invention is shown in FIG. 10, where similar numerals refer to similar structure in the first embodiment 100. In the third embodiment 300, with the handle 340 extending substantially longitudinally away from the blades 302,304 to a free proximal end 344, the handle longitudinal axis 342 may be angled slightly right (as shown) or left from the just described position by a predetermined angle 346 so as to facilitate the serving of foodstuffs, as can be seen in FIG. 10. A preferred predetermined handle angle 346, measured relatively to a kerf 303 to be formed by the cutter 300 is zero degrees to about forty-five degrees.

Figure 11:
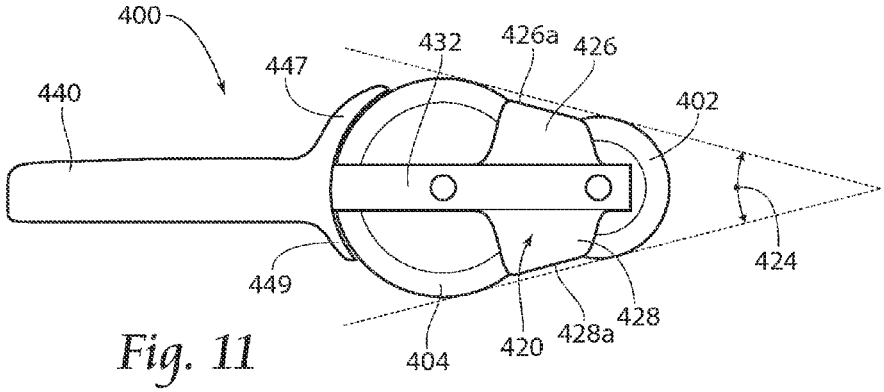
FIG. 11 is a left elevation view of a fourth embodiment of a cutter according to the present invention.
Figure 12:
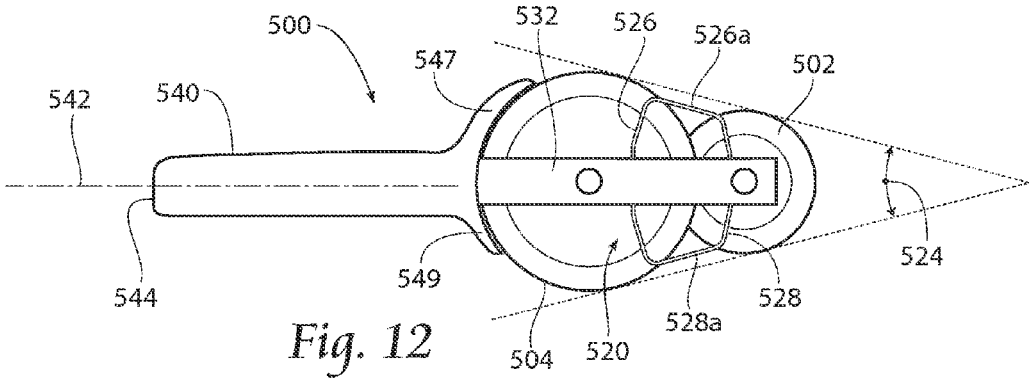
FIG. 12 is a left elevation view of a fifth embodiment of a cutter according to the present invention.
Figure 13:
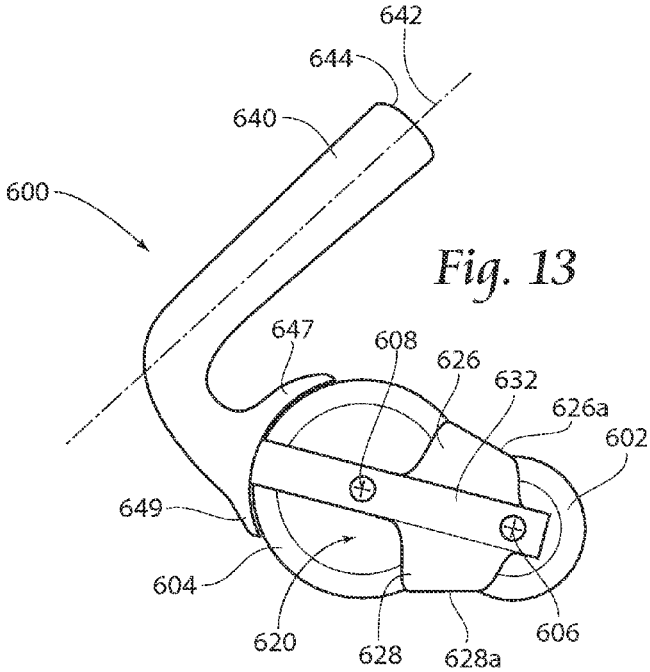
FIG. 13 is a left elevation view of a sixth embodiment of a cutter according to the present invention.

Additionally or alternatively, the cutter frame structure or support surface may include serving support wings or rails, as shown in FIGS. 11-13. A fourth embodiment of a cutter 400 according to the present invention is shown in FIG. 11, where similar numerals refer to similar or identical structure in the first embodiment 100. In the fourth embodiment 400, a first support wing 426 and a second support wing 428 extend outward from the first support rail 432, generally parallel to the blades 402,404. The wings 426,428 may be formed from a solid piece of material, such as plastic or stainless steel, and be coupled to or formed integrally with the support rail 432. The wings 426,428 may overlap one or both of the blades 402,404, as shown, or the wings 426,428 may be disposed between the blades 402,404 so as to span some otherwise open space therebetween. The wings 426,428 preferably have outer edges 426*a*,428*a* that lie, with respect to each other, at an angle substantially equal to the support surface angle 424. A fifth embodiment of a cutter 500 according to the present invention is shown in FIG. 12, where similar numerals refer to similar or identical structure in the first embodiment 100. In the fifth embodiment 500, a first support wire 526 and a second support wire 528 extend outward from the first support rail 532, generally parallel to the blades 502,504. The wires 526,528 may be formed from an extruded or stamped piece of material, such as stainless steel, and be coupled to or formed integrally with the support rail 532. The wires 526, 528 may overlap one or both of the blades 502,504, as shown, or the wires 526,528 may be disposed between the blades 502,504 so as to span some otherwise open space therebetween. The wires 426,428 preferably have outer portions 526*a*,528*a* that lie, with respect to each other, at an angle substantially equal to the support surface angle 524.

A sixth embodiment of a cutter 600 according to the present invention is shown in FIG. 13, where similar reference numerals refer to similar or identical structure in the first embodiment 100. The sixth embodiment 600 may be substantially the same as the fourth embodiment 400 with the exception of the handle 640. In the sixth embodiment, the handle axis 642 is preferably disposed at an acute angle relative to the first support rail 632, or more particularly at an acute angle with respect to a line segment disposed between the blade axes 606,608. In use, this design is expected to provide a user with increased cutting leverage.

Figure 14:
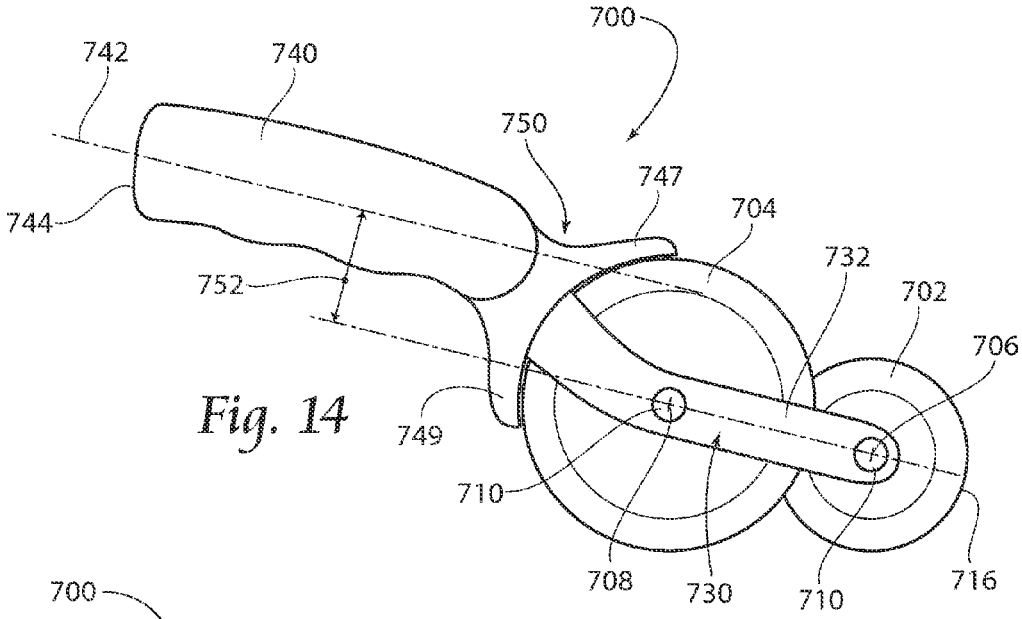
FIG. 14 is a left elevation view of a seventh embodiment of a cutter according to the present invention.
Figure 15:
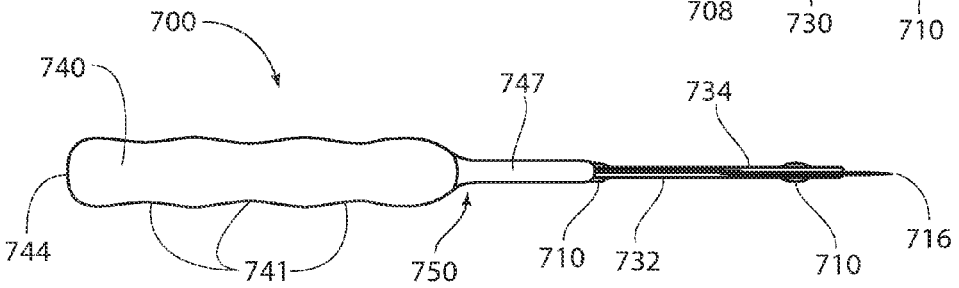
FIG. 15 is a top plan view of the embodiment of FIG. 14.

Instead of having a handle aligned orthogonal to the blade axes, the handle may be positioned along a longitudinal axis that is located substantially orthogonally skew to the blade axes, such as the arrangements shown in FIGS. 14-20. A seventh embodiment of a cutter 700 according to the present invention is shown in FIGS. 14-15, where similar reference numerals refer to similar or identical structure in the first embodiment 100. In this fashion, the handle 740 may extend between a free handle end 744 and a frame end 750 coupled to a frame structure 730 adapted to support the blades 702,704 and/or blade axles 710. The handle axis 742 may run generally parallel to, and spaced a predetermined distance 752 from, a line that orthogonally intersects the two blade axes 706,708.

Figure 16:
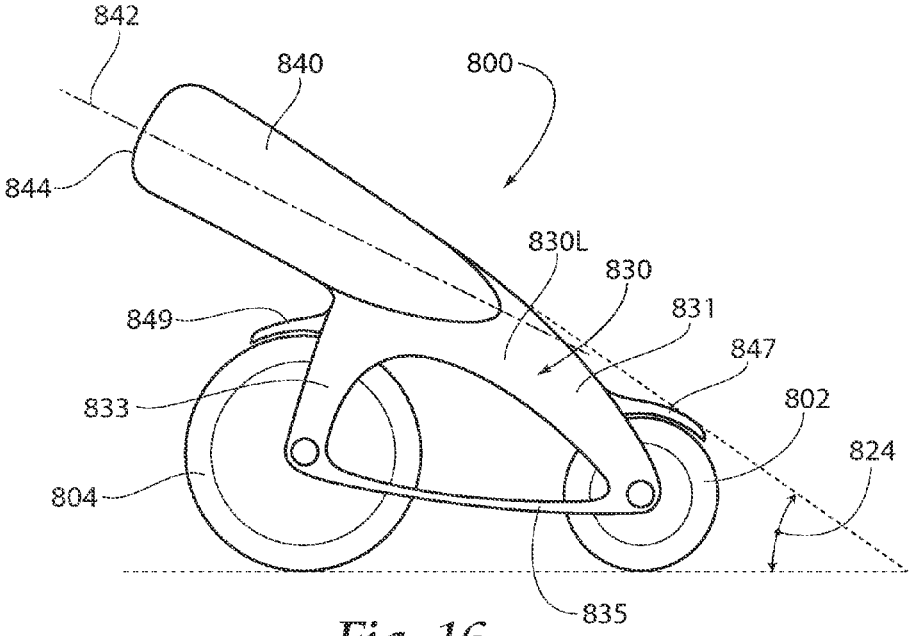
FIG. 16 is a left elevation view of an eighth embodiment of a cutter according to the present invention.

While, above, the blades could be canted to provide a narrow cutting kerf, another option would be to space the blade axes at a distance greater than the sum of adjacent blade major radii, so as to allow for blade alignment. In such embodiment, the handle may have a thicker free end for a comfortable grip (which may include undulations 741) and extend into a thinner serving frame portion that may support a plurality of rotary blades, as shown in FIGS. 16-20. FIG. 16 depicts an eighth embodiment of a cutter 800 according to the present invention, where similar reference numerals refer to similar or identical structure to the first embodiment 100. This embodiment 800 includes as a mounting frame 830 a mounting plate including a first leg 831 extending from the handle 840 towards the first blade 802, a second leg 833 extending from the handle 840 towards the second blade 804, and a third reinforcement member 835 preferably extending generally between the two blades 802,804. The mounting plate generally may include a left surface 830L (visible in FIG. 16) and an opposing right surface (e.g., 930R in FIG. 18), each of which may be substantially planar. The left and right surfaces are separated by a mounting plate thickness 937. Between the left and right surfaces, a blade slot (e.g., 939 in FIG. 18) may be configured to receive at least a portion of each blade, which is rotatably supported on a blade axle, which preferably extends through both the left and right surfaces. To assist in cleaning the device, one or more access apertures may be provided through the left and/or right mounting plate surfaces into the blade slot (e.g., 939 in FIG. 18). This embodiment 800 shows that other portions of the device 800, other than the blades 802,804, may be used to form a transfer surface. That is, a tangent formed between the blades 802,804 and a tangent formed along the mounting plate 830 and finger guard 847 may be disposed at transfer surface angle 824 of between about 30 degrees to about 45 degrees. When the word "about" is used, it generally refers to +/− one third of the measurement modified by such adjective.

Figure 17:
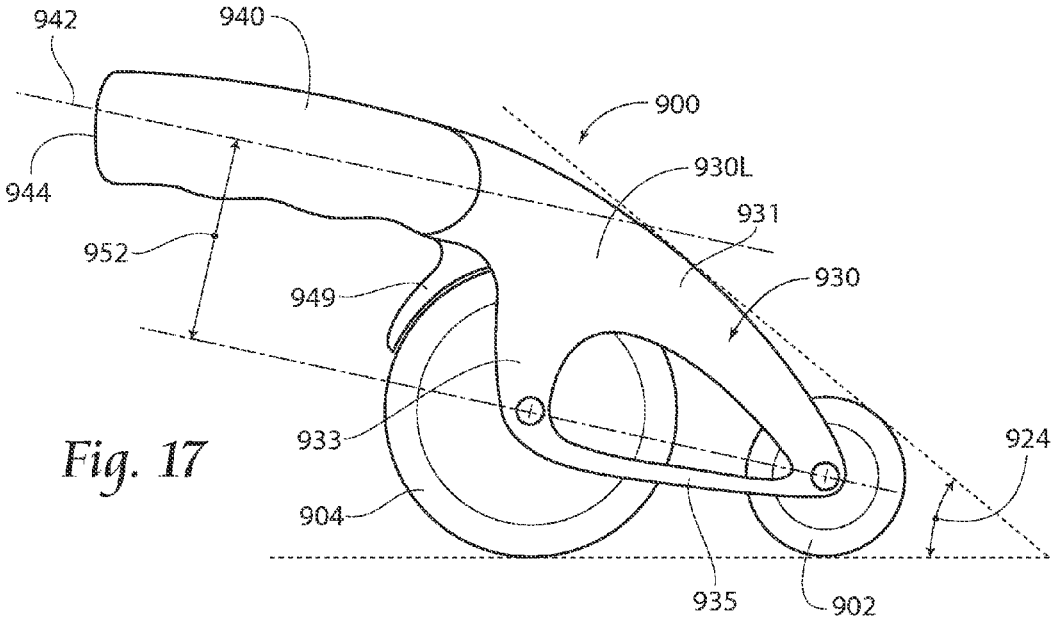
FIG. 17 is a left elevation view of a ninth embodiment of a cutter according to the present invention.
Figure 18:
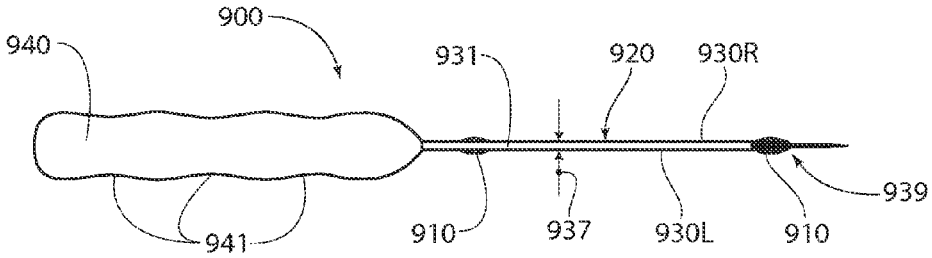
FIG. 18 is a top plan view of the embodiment of FIG. 17.
Figure 19:
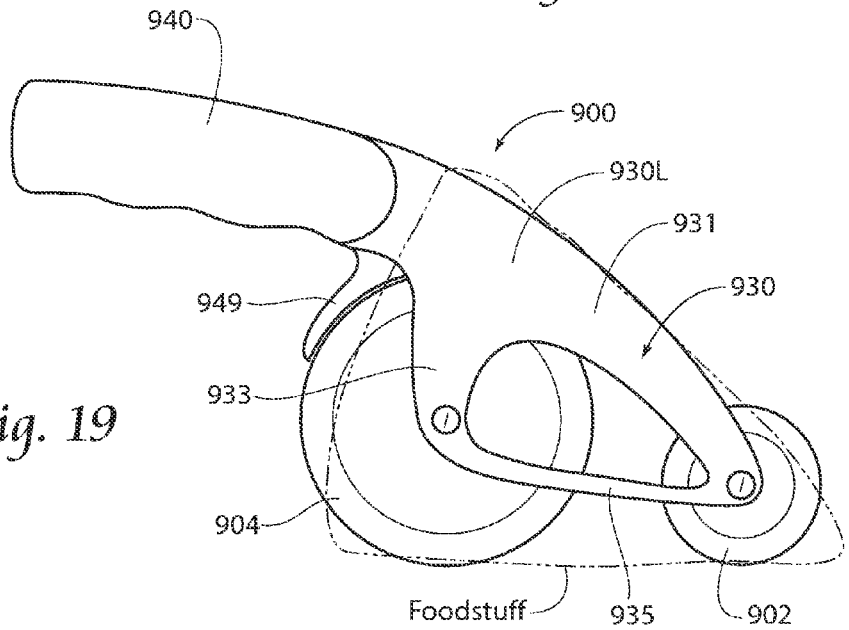
FIG. 19 is a left elevation view of the embodiment of FIG. 17 shown serving a foodstuff.

FIGS. 17-19 depict a ninth embodiment of a cutter 900 according to the present invention, where similar reference numerals refer to similar or identical structure to the seventh 700 or eighth 800 embodiments. The ninth embodiment 900 is similar to the eighth embodiment 800, but the handle 940 has been moved rearward and disposed along a handle longitudinal axis 942 which is situated substantially parallel to and at a predetermined handle spacing 952 from a reference plane that includes both the first blade axis and the second blade axis. In this embodiment 900, the transfer surface angle 924 is formed by a first tangent that may be drawn between the blades 902,904, and a second tangent that may be drawn between the first blade 902 and the mounting plate 930, where such angle 924 is between about 30 degrees to about 45 degrees.

Figure 20:
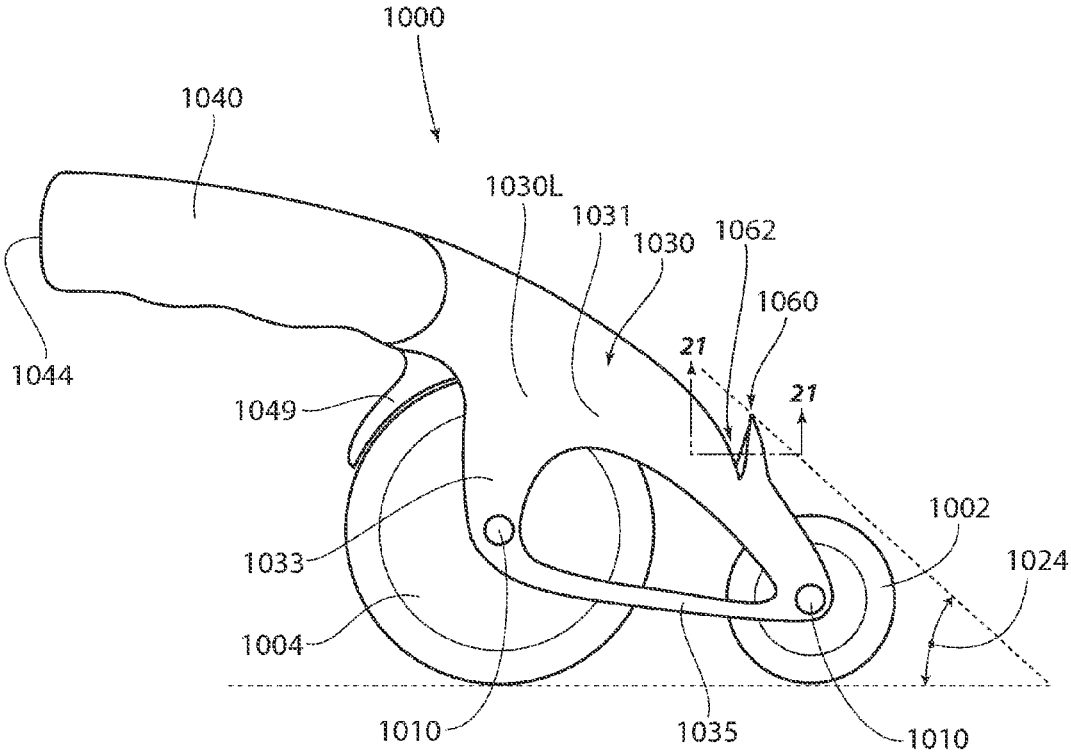
FIG. 20 is a left elevation view of a tenth embodiment of a cutter according to the present invention.
Figure 21:
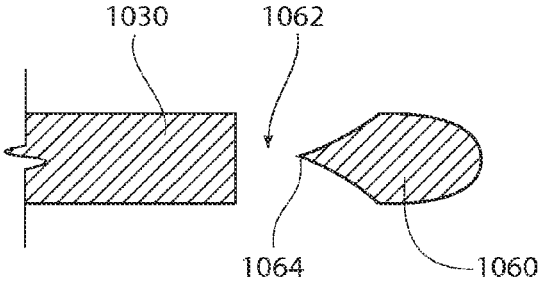
FIG. 21 is a partial cross-section view taken along lines 21-21 of FIG. 20.

FIGS. 20-21 depict a tenth embodiment of a cutter 1000 according to the present invention, where similar reference numerals refer to similar or identical structure to the ninth embodiment 900. This embodiment 1000 includes a secondary cutter component 1060 disposed on or formed integrally with the mounting plate 1030, preferably on the first leg 1031. The secondary cutter component 1060 includes a cutting gap 1062 and a cutting member 1064. The gap 1062 is configured to receive, e.g., plastic foodwrap, and the cutting member 1064 is adapted to cut same. The cutting member 1064 may be formed integrally with the leg 1031, such as by being a sharpened portion thereof, or it 1064 may be an inserted cutting member such as a blade. In this embodiment 1000, the transfer surface angle 1024 is formed by a first tangent that may be drawn between the blades 1002,1004, and a second tangent that may be drawn between the first blade 1002 and the mounting plate cutter component 1060, where such angle 1024 is between about 30 degrees to about 45 degrees.

To use a device x00 according to the present invention, an article, such as a foodstuff (e.g. pizza) is cut on a cutting surface to form a severed portion of the article. The device x00 may then be used to transfer the severed portion from the cutting surface to another support surface. To transfer the severed portion, the device x00 may be rotated, such as about the handle longitudinal axis x42 by an angle of about ninety degrees to establish a transfer surface x20 to slide under the severed article and support same during transfer.

Any handle X40 according to the present invention is preferably formed from plastic or stainless steel, which may be formed integrally with the mounting frame X30, but it may include relatively soft (durometer) overmolding or grip portions, which may include one or more finger indentations X41, added to the plastic or stainless steel to aid in comfort.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A device comprising:

a handle including a free end;

a mounting frame coupled to the handle, the mounting frame comprising a mounting plate including left and right surfaces oppositely disposed and separated by a mounting plate thickness;

a first blade coupled to the mounting frame, the first blade rotatable about a first axis; and a second blade coupled to the mounting frame, the second blade rotatable about a second axis, wherein the left and right surfaces are substantially planar and the mounting plate includes a blade slot formed between the left and right surfaces, the blade slot configured to receive at least a portion of the blades, wherein the first blade is a first circular blade having a first major diameter and the second blade is a second circular blade having a second major diameter, wherein the first major diameter is smaller than the second major diameter and the second axis is disposed closer to the handle than the first axis, wherein the first axis and the second axis are separated by a distance that is greater than the sum of half of the first major diameter and half of the second major diameter, wherein a first tangent intersects a first point on the first blade and a second point on the second blade, wherein a second tangent intersects a third point on the first blade and a fourth point on the mounting plate, wherein the first tangent and the second tangent intersect at a tangent vertex, wherein the first blade is located between the second blade and the tangent vertex, and wherein the first tangent and the second tangent are disposed at a transfer surface angle of between about thirty degrees to about forty-five degrees.

* * * * *